US008530800B2

(12) United States Patent
Adachi et al.

(10) Patent No.: US 8,530,800 B2
(45) Date of Patent: Sep. 10, 2013

(54) HEATER CONTROL DEVICE, IMAGE FORMING APPARATUS, AND COMPUTER PROGRAM PRODUCT

(75) Inventors: Hiroshi Adachi, Kanagawa (JP); Eiji Nemoto, Tokyo (JP); Takuma Kasai, Kanagawa (JP); Kiriko Chosokabe, Tokyo (JP); Norikazu Okada, Kanagawa (JP)

(73) Assignee: Ricoh Company, Limited, Tokyo (JP)

( * ) Notice: Subject to any disclaimer, the term of this patent is extended or adjusted under 35 U.S.C. 154(b) by 429 days.

(21) Appl. No.: 12/881,708

(22) Filed: Sep. 14, 2010

(65) Prior Publication Data

US 2011/0064444 A1 Mar. 17, 2011

(30) Foreign Application Priority Data

Sep. 15, 2009 (JP) ..... 2009-212610
Sep. 15, 2009 (JP) ..... 2009-213792
Sep. 10, 2010 (JP) ..... 2010-203744

(51) Int. Cl.
*H05B 1/02* (2006.01)

(52) U.S. Cl.
USPC ..... 219/497; 219/492; 219/501; 219/483; 219/216; 399/69

(58) Field of Classification Search
USPC ..... 219/492, 497, 501, 506, 483–486, 219/216; 399/67, 69
See application file for complete search history.

(56) References Cited

U.S. PATENT DOCUMENTS 4,334,147 A * 6/1982 Payne ..... 219/497
5,994,671 A 11/1999 Suzuki et al.
6,853,818 B2 2/2005 Nishida
7,283,145 B2 * 10/2007 Kato et al. ..... 347/156
8,063,341 B2 * 11/2011 Iwasaki ..... 219/216
2007/0116485 A1 5/2007 Nishida (Continued)

FOREIGN PATENT DOCUMENTS

CN 101286030 A 10/2008
CN 100485547 C 5/2009

(Continued)

OTHER PUBLICATIONS

U.S. Appl. No. 12/725,630, filed Mar. 17, 2010.

(Continued)

*Primary Examiner* — Mark Paschall
(74) *Attorney, Agent, or Firm* — Oblon, Spivak, McClelland, Maier & Neustadt, L.L.P.

(57) ABSTRACT

A heater control device includes a temperature detector that detects a temperature of a heated object heated by a heater; an alternating-current power supply for applying an alternating current voltage to the heater; a turn-on ratio decision unit that determines a turn-on ratio of the heater based on the temperature and a target temperature; a turn-on pattern decision unit that determines a partial turn-on pattern, as the turn-on pattern of the heater, which is a pattern of a turn-on ratio higher than the determined turn-on ratio in terms of a control-period, and to which a partial turn-on instead of a full turn-on is allocated on a half-wavelength basis of the alternating current voltage within the control period based on the turn-on ratio of the heater; and a turn-on controller that controls turn-on of the heater based on the determined turn-on pattern.

19 Claims, 9 Drawing Sheets

(56) References Cited

U.S. PATENT DOCUMENTS

| | | | |
|---|---|---|---|
| 2007/0284357 | A1 | 12/2007 | Takahashi et al. |
| 2008/0253791 | A1 | 10/2008 | Chosokabe |
| 2009/0074442 | A1 | 3/2009 | Sano et al. |

FOREIGN PATENT DOCUMENTS

| | | | |
|---|---|---|---|
| EP | 0 797 130 | A2 | 9/1997 |
| EP | 1 698 948 | A1 | 9/2006 |
| EP | 1 980 918 | A2 | 10/2008 |
| JP | 3316170 | | 6/2002 |
| JP | 2004-212510 | | 7/2004 |
| JP | 2006-164615 | A | 6/2006 |
| JP | 2008-191333 | | 8/2008 |

OTHER PUBLICATIONS

Extended European Search Report issued May 31, 2001, in Application No. / Patent No. 10176636.8—1240 / 2296057.

Combined Chinese Office Action and Search Report Issued Dec. 31, 2012 in Patent Application No. 201010286421.7 (with English translation of Categories of Cited Documents).

* cited by examiner

HEATER CONTROL DEVICE, IMAGE FORMING APPARATUS, AND COMPUTER PROGRAM PRODUCT

CROSS-REFERENCE TO RELATED APPLICATIONS

The present application claims priority to and incorporates by reference the entire contents of Japanese Patent Application No. 2009-212610 filed in Japan on Sep. 15, 2009, Japanese Patent Application No. 2009-213792 filed in Japan on Sep. 15, 2009 and Japanese Patent Application No. 2010-203744 filed in Japan on Sep. 10, 2010.

BACKGROUND OF THE INVENTION

1. Field of the Invention

The present invention relates to a heater control device for controlling turn-on of a heater, an image forming apparatus, and a computer program product.

2. Description of the Related Art

As a fixing heater used for an electrophotographic image forming apparatus, a halogen heater is widely used. The halogen heater among heaters has a characteristic that inrush current easily occurs particularly at a low temperature, and consumed current is continuously large. Therefore, a voltage drop occurs at a commercial power supply in synchronization with a turn-on timing of the heater, which causes a lighting device such as a fluorescent light to flicker.

There is known a technology for controlling a turn-on pattern on a half-wave cycle basis in a period of 10 half-wavelengths (100 ms) close to a frequency caused to flicker so that turn-on control of the heater is prevented from switching at about 10 Hz band with respect to a flickering frequency band (8.8 to 10 Hz) to which human eyes are sensitive, or so that a frequency component becomes as small as possible (see, e.g., Japanese Patent No. 3316170). This deals with problems such as flicker and control of a harmonic current and of a noise terminal voltage.

Moreover, as a purpose of preventing the inrush current, there is proposed a technology for introducing phase control (soft start) that a heater is turned on for only a part of a half-wavelength right before the high-frequency turn-on pattern and the on-time is made gradually longer (see, e.g., Japanese Patent Application Laid-open No. 2004-212510).

However, in the heater control using the turn-on pattern on the half-wave cycle basis in the period of 10 half-wavelengths, a difference occurs in a flicker level caused by a turn-on duty (turn-on ratio), and it is understood that frequency characteristics are worse in low duty (around 10 to 30%) as compared with that in medium duty (around 40 to 60%) and that the flicker level tends to be bad.

Therefore, there is a problem that inrush current caused by a very short turn-off period (a few 10 msec) during the turn-on cannot be prevented and thus improvement of the flicker level is not expected so much in the low duty in which the turn-off period continues for several half waves or more. Moreover, there is a problem that the number of turn-ons is small in the low duty and the frequency component cannot be improved (frequency cannot be made higher). There is also a problem that when the phase control is used during the turn-on, the characteristics of the harmonic current and the noise terminal voltage may be extremely worsened.

SUMMARY OF THE INVENTION

It is an object of the present invention to at least partially solve the problems in the conventional technology.

According to an aspect of the present invention, there is provided a heater control device that includes a temperature detector that detects a temperature of a heated object heated by a heater; an alternating-current power supply for applying an alternating current voltage to the heater; a turn-on ratio decision unit that determines a turn-on ratio of the heater based on the temperature and a target temperature; a turn-on pattern decision unit that determines a partial turn-on pattern, as a turn-on pattern of the heater, which is a pattern of a turn-on ratio higher than determined turn-on ratio in terms of a control period, and to which a partial turn-on instead of a full turn-on is allocated on a half-wavelength basis of the alternating current voltage within the control period, based on the turn-on ratio of the heater; and a turn-on controller that controls turn-on of the heater based on determined turn-on pattern.

According to another aspect of the present invention, there is provided an image forming apparatus that includes a fixing unit that includes a heater, and a temperature detector for detecting a temperature of a heated object heated by the heater; an alternating-current power supply for applying an alternating current voltage to the heater; a turn-on ratio decision unit that determines a turn-on ratio of the heater based on the temperature and a target temperature; a turn-on pattern decision unit that determines a partial turn-on pattern, as a turn-on pattern of the heater, which is a pattern of a turn-on ratio higher than determined turn-on ratio in terms of a control-period, and to which a partial turn-on instead of a full turn-on is allocated on a half-wavelength basis of the alternating current voltage within the control period, based on the turn-on ratio of the heater; and a turn-on controller that controls turn-on of the heater based on determined turn-on pattern.

According to still another aspect of the present invention, there is provided a computer program product that includes a computer-readable recording medium containing instructions for controlling a heater. The instructions, when executed by a computer, cause the computer to perform determining a turn-on ratio of the heater based on a temperature of a heated object heated by the heater and a target temperature; determining a partial turn-on pattern, as a turn-on pattern of the heater, which is a pattern of a turn-on ratio higher than determined turn-on ratio in terms of a control-period, and to which a partial turn-on instead of a full turn-on is allocated on a half-wavelength basis of the alternating current voltage within the control period, based on the turn-on ratio of the heater; and controlling turn-on of the heater based on determined turn-on pattern.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Exemplary embodiments of a heater control device, an image forming apparatus, and a program according to the present invention will be explained in detail below with reference to the accompanying drawings.

(First Embodiment)

Figure 1:
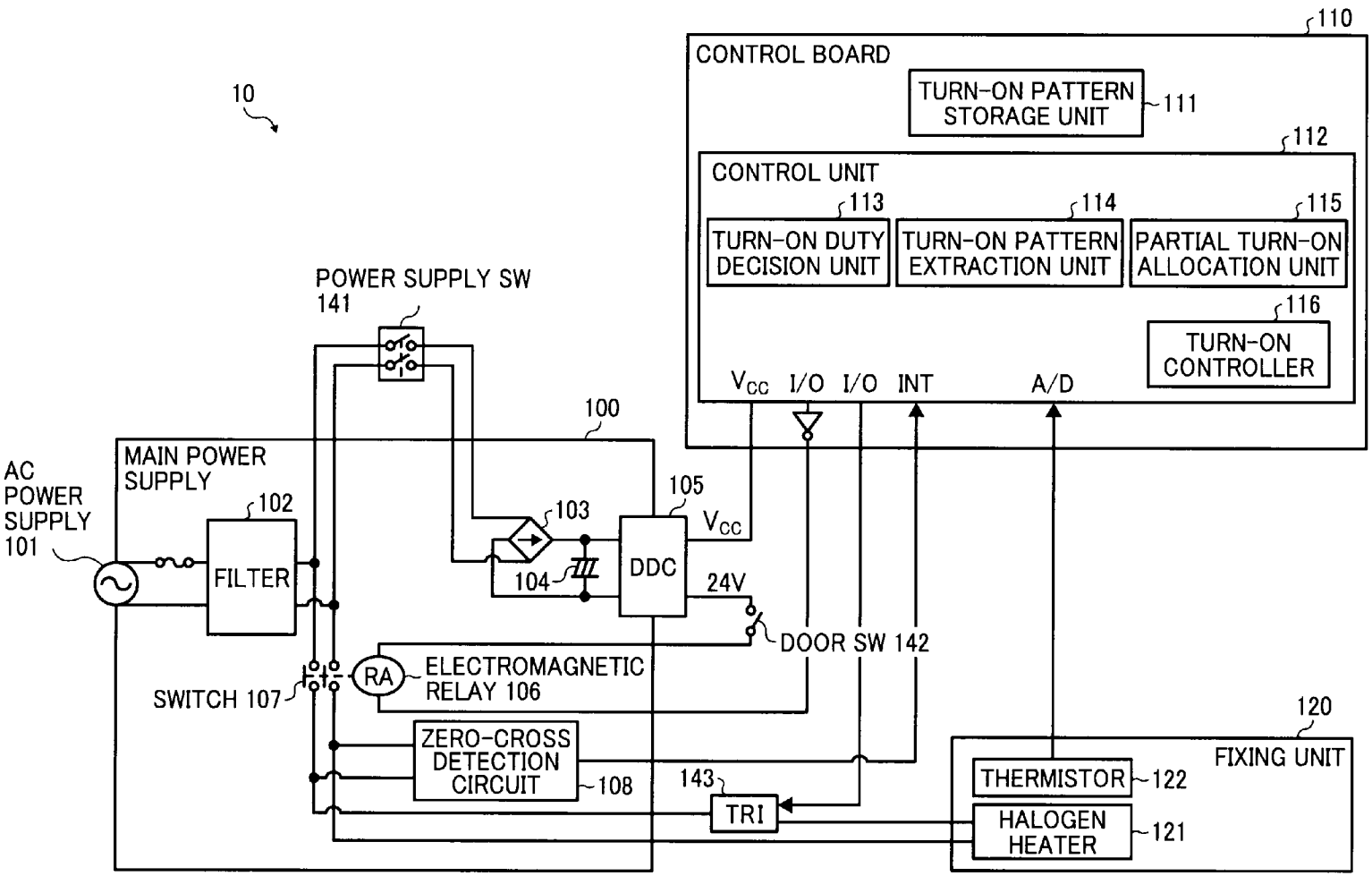
FIG. 1 is a block diagram of an entire configuration of an image forming apparatus according to a first embodiment.

FIG. 1 is a block diagram of an entire configuration of an image forming apparatus 10 according to an embodiment of the present invention. The image forming apparatus 10 includes the heater control device for controlling a heater in a fixing unit or the like provided in the image forming apparatus 10. More specifically, the image forming apparatus 10 mainly includes a main power supply 100 and a control board 110. The image forming apparatus 10 further includes a fixing unit 120, a power supply SW 141, and a door SW 142.

The control board 110 controls the entire image forming apparatus 10. The control board 110 is implemented as a computer including a CPU, a RAM, a ROM, a NVRAM, an ASIC (Application Specific Integrated Circuit) (not shown), and an input-output interface, which are connected to each other via a bus.

The control board 110 controls on/off of a triac (TRI) 143 and an electromagnetic relay 106 internally provided in the main power supply 100, to control temperature and on/off of a halogen heater 121 of the fixing unit 120. Any other heater such as a ceramic heater may be used instead of the halogen heater 121.

A thermistor 122 provided near the halogen heater 121 of the fixing unit 120 detects a surface temperature of a heated object of the halogen heater 121. The control board 110 performs A/D conversion on the surface temperature of the heated object detected by the thermistor 122, to detect the surface temperature of the heated object of the halogen heater 121. The control board 110 controls on/off of the TRI 143 and the electromagnetic relay 106 so that the surface temperature is stabilized.

When the power supply SW 141 of the image forming apparatus 10 is turned on, noise of a current supplied from an AC power supply 101 is removed by a filter 102, and is then smoothed by a rectifier diode 103 and a smoothing capacitor 104, to be supplied to a DDC (Digital Down Converter) 105. The DDC 105 is a switching type DC to DC converter, and supplies a constant voltage Vcc to the control board 110 and 24 volts to the electromagnetic relay 106.

The electromagnetic relay 106 can turn on a switch 107 and also can turn off the fixing unit 120 via the control board 110 in response to turning on of the door SW 142 of the image forming apparatus 10. That is, the electromagnetic relay 106 functions as a safety device of the fixing unit 120.

A zero-cross detection circuit 108 detects a zero cross point of the AC power supply 101. The control board 110 turns on/off the TRI 143 according to the zero cross point. If the switch 107 is on, then the voltage of an alternating current supplied to the zero-cross detection circuit 108 approaches zero at each half-wavelength. Therefore, a transistor of the zero-cross detection circuit 108 cannot hold the on-voltage. The zero-cross detection circuit 108 detects this state of the transistor and outputs a zero-cross signal to the control board 110.

The control board 110 includes a turn-on pattern storage unit 111 and a control unit 112. The control unit 112 performs thinning control for controlling on/off of energization to the halogen heater 121 using a half-wavelength of an alternating current voltage as one unit. The control unit 112 also performs thinning-phase control as a combination of phase control for turning on only a part of the half-wavelength and the thinning control. The thinning-phase control will be explained later. The control unit 112 controls, specifically, turn-on of the halogen heater 121 according to the turn-on pattern stored in the turn-on pattern storage unit 111.

The turn-on pattern storage unit 111 stores therein turn-on patterns. The turn-on pattern is a turn-on pattern of the halogen heater 121 on a control-period basis. The control period is a voltage period of the AC power supply 101 controlled by the control board 110, and is a period of a preset length. In the present embodiment, the control period is set to 10 half-wavelengths. The turn-on pattern stored in the turn-on pattern storage unit 111 is set in terms of 10 half-wavelengths corresponding to the above-mentioned wavelengths.

Figure 2:
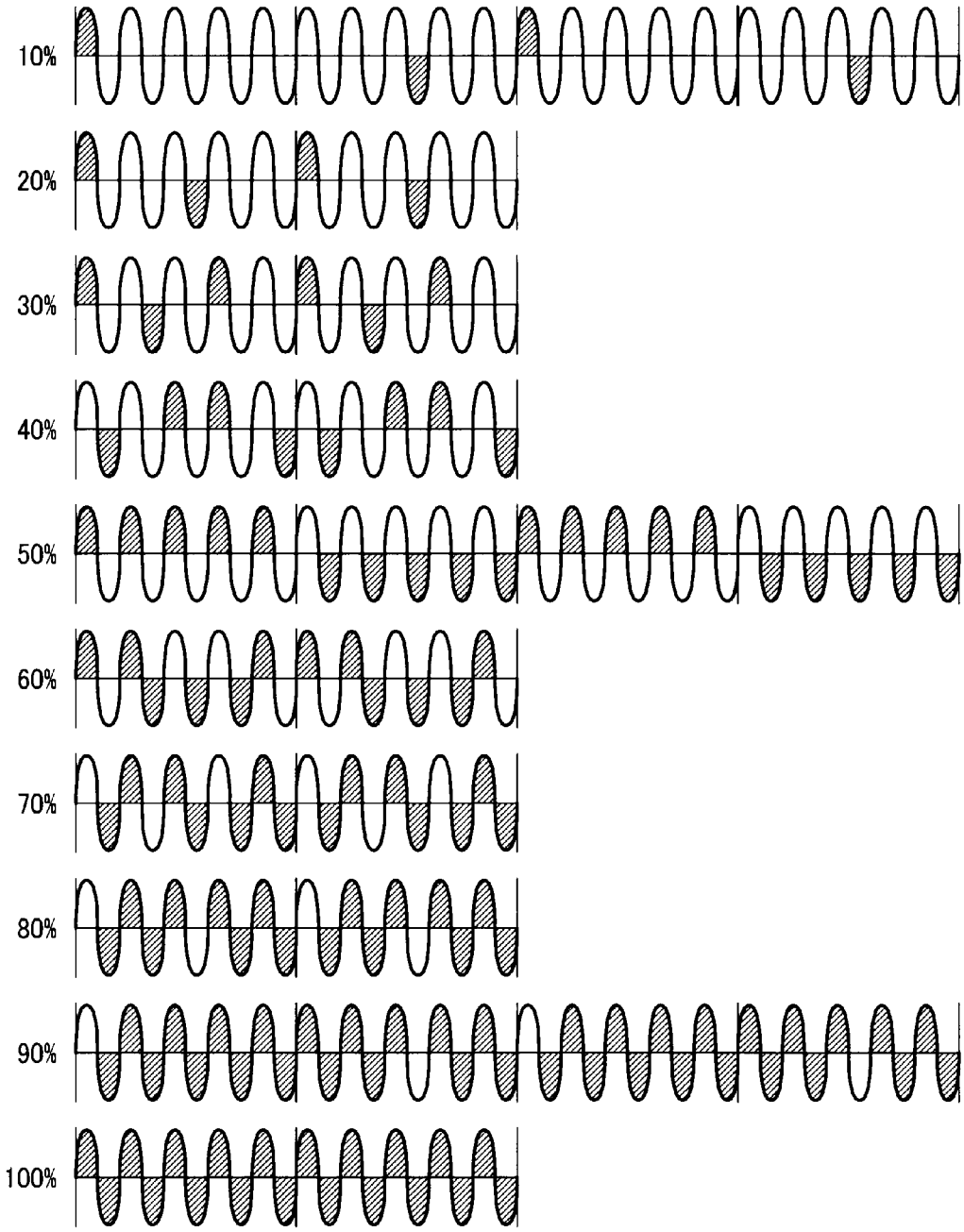
FIG. 2 is a schematic diagram representing turn-on patterns.

FIG. 2 is a schematic diagram representing turn-on patterns. The turn-on pattern storage unit 111 stores therein turn-on patterns associated with turn-on duties respectively. Here, the turn-on duty is a turn-on ratio of the halogen heater 121. In the present embodiment, 10 turn-on patterns are stored therein at 10% turn-on duty intervals. In FIG. 2, half-wavelengths indicated by diagonal lines are areas equivalent to turn-on of the halogen heater 121. For example, when the turn-on duty is 30%, turn-on of the halogen heater 121 is set to predetermined 3 half-wavelengths of the 10 half-wavelengths. Thus, the turn-on patterns stored in the turn-on pattern storage unit 111 are thinning patterns used to thin out a turn-on period of the halogen heater 121 on the half-wavelength basis. The turn-on control of the halogen heater 121 using the thinning pattern is called "thinning control".

The turn-on patterns stored in the turn-on pattern storage unit 111 according to the present embodiment are turn-on patterns with which frequency bands of around 10 Hz are avoided. That is, the turn-on patterns are allocated with full turn-ons or full turn-offs so as to avoid flicker. In the present embodiment, when the turn-on duty is 10%, a half-wave control pattern based on 20 half-wavelengths set as the control period is stored therein.

The control unit 112 in FIG. 1 includes a turn-on duty decision unit 113, a turn-on pattern extraction unit 114, a partial turn-on allocation unit 115, and a turn-on controller 116. The turn-on duty decision unit 113 determines a turn-on duty based on a surface temperature of a heated object of the halogen heater 121 detected by the thermistor 122 and also based on a target temperature.

The turn-on pattern extraction unit 114, when the turn-on duty determined by the turn-on duty decision unit 113 is equal to or less than a preset threshold, extracts a turn-on pattern associated with a turn-on duty that is higher than the turn-on duty determined by the turn-on duty decision unit 113, from the turn-on pattern storage unit 111. In the present embodiment, the threshold is set to 30%. The threshold should be an arbitrary value and is therefore not limited to the embodiment.

The turn-on pattern to be extracted when the turn-on duty is less than the threshold is previously set. In the present embodiment, when the turn-on duty is determined as 10%, a 40% turn-on pattern which is excellent in frequency characteristics is to be extracted. However, the turn-on pattern to be extracted is not limited to 40%, and thus a turn-on pattern of any other turn-on duty which is equal to or higher than the threshold may be extracted.

Meanwhile, when the turn-on duty determined by the turn-on duty decision unit 113 is higher than the threshold, the turn-on pattern extraction unit 114 extracts a turn-on pattern associated with the turn-on pattern determined by the turn-on duty decision unit 113.

The partial turn-on allocation unit 115, when the turn-on pattern extraction unit 114 extracts a turn-on pattern associated with a turn-on duty that is higher than the turn-on duty determined by the turn-on duty decision unit 113 from the turn-on pattern storage unit 111, allocates a partial turn-on, instead of a full turn-on, to a half-wavelength allocated with the full turn-on in the turn-on pattern extracted by the turn-on pattern extraction unit 114. As a result, the partial turn-on pattern of the halogen heater 121 is determined as the turn-on pattern of the halogen heater 121. Here, the partial turn-on represents that the halogen heater 121 is turned on for only a part of period of the half-wavelength. That is, the partial turn-on is a control to change the phase of an alternating current voltage supplied to the halogen heater 121.

The turn-on pattern obtained by the partial turn-on allocation unit 115 is a pattern in which a partial turn-on is allocated to a thinning pattern, and turn-on control of the halogen heater 121 using this turn-on pattern is called "thinning-phase control".

The turn-on controller 116 controls turn-on of the halogen heater 121 based on the turn-on pattern extracted by the turn-on pattern extraction unit 114 or based on the turn-on pattern allocated with the partial turn-on by the partial turn-on allocation unit 115.

Figure 3:
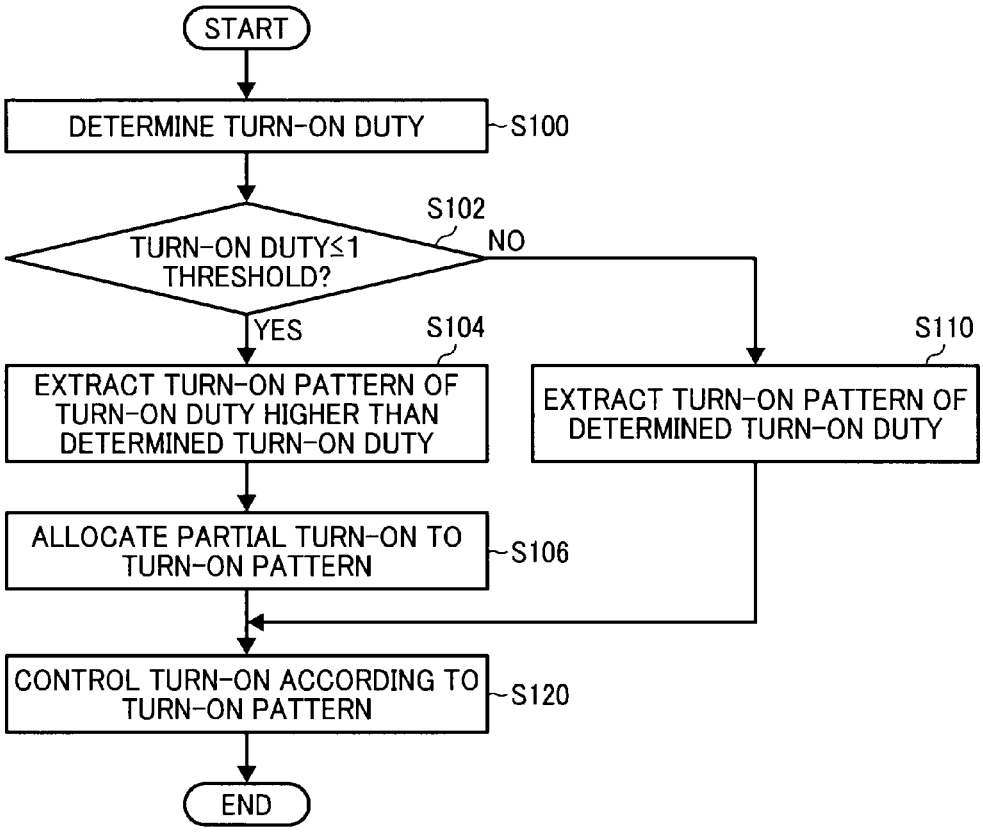
FIG. 3 is a flowchart of a heater control process performed by the image forming apparatus according to the first embodiment.

FIG. 3 is a flowchart of a heater control process performed by the image forming apparatus 10. First, the turn-on duty decision unit 113 determines a turn-on duty (Step S100). If the turn-on duty determined by the turn-on duty decision unit 113 is equal to or less than the threshold (30%) (Yes at Step S102), the turn-on duty decision unit 113 extracts a turn-on pattern associated with a turn-on duty which is higher than the determined turn-on duty, from the turn-on pattern storage unit 111 (Step S104). In the present embodiment, the 40% turn-on pattern is extracted. Next, the partial turn-on allocation unit 115 allocates a partial turn-on to a half-wavelength, of the turn-on pattern extracted by the turn-on pattern extraction unit 114, to which the full turn-on is allocated (Step S106). Next, the turn-on controller 116 controls turn-on of the halogen heater 121 according to the turn-on pattern to which the partial turn-on is allocated by the partial turn-on allocation unit 115 (Step S120).

Meanwhile, at Step S102, when the turn-on duty is higher than the threshold (No at Step S102), the turn-on pattern extraction unit 114 extracts the turn-on pattern associated with the turn-on duty determined by the turn-on duty decision unit 113, from the turn-on pattern storage unit 111 (Step S110). Then, the turn-on controller 116 controls turn-on of the halogen heater 121 according to the turn-on pattern extracted by the turn-on pattern extraction unit 114 (Step S120). At this point, the heater control process is completed.

Figure 4:
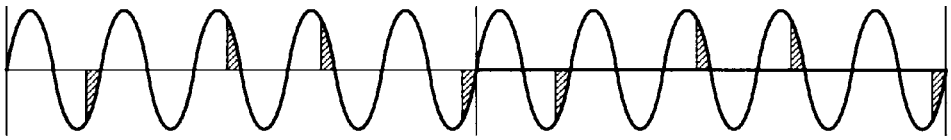
FIG. 4 is a diagram representing one example of a 40% turn-on pattern to which partial turn-ons are allocated by a partial turn-on allocation unit according to the first embodiment.

FIG. 4 is a diagram representing one example of a turn-on pattern to which partial turn-ons are allocated by the partial turn-on allocation unit 115. If the turn-on duty is determined as 10% by the turn-on duty decision unit 113, the turn-on pattern extraction unit 114 extracts the 40% turn-on pattern from the turn-on pattern storage unit 111. The partial turn-on allocation unit 115, as shown in FIG. 4, allocates partial turn-ons instead of full turn-ons to half-wavelengths, of the 40% turn-on pattern, to which the full turn-ons are allocated.

When the turn-on duty is low, a period during which the halogen heater 121 is on becomes short within the control period. Therefore, if the turn-on control is performed using the turn-on pattern stored in the turn-on pattern storage unit 111, there arises a problem that inrush current increases caused by continuation of a turn-off period.

On the other hand, the image forming apparatus 10 according to the present embodiment is configured to reduce the turn-off period by dividing a turn-on of 1 or 2 or more of half-wavelengths set by the turn-on duty into partial turn-ons in a plurality of half-wavelengths and allocating the partial turn-ons within the control period. Moreover, it is configured that the half-wavelength allocated with the partial turn-on follows the turn-on pattern stored in the turn-on pattern storage unit 111. This enables an increase in inrush current to be prevented and flicker to be reduced.

Next, a partial turn-on allocation process will be explained below. The partial turn-on allocation unit 115 according to the present embodiment sets a ratio of turn-ons in half-wavelengths so that the sum of turn-on power required for a plurality of partial turn-ons allocated to the turn-on pattern becomes equal to the sum of turn-on power set from the turn-on duty determined by the turn-on duty decision unit 113. Furthermore, it is set so that the values of turn-on power in the partial turn-ons are equal to each other.

Figure 5A:
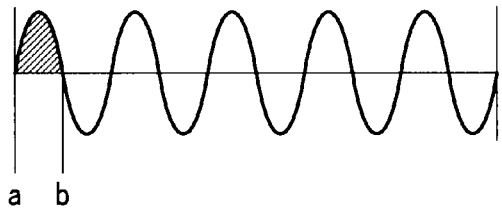
FIG. 5A is a diagram for explaining how to calculate a ratio of a partial turn-on to a half-wavelength.
Figure 5B:
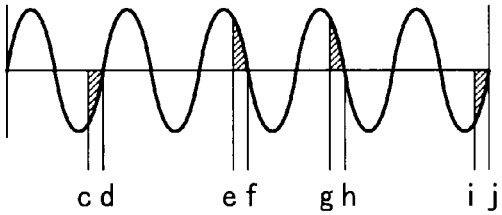
FIG. 5B is a diagram for explaining how to calculate a ratio of a partial turn-on to a half-wavelength.

Referring to FIGS. 5A and 5B, an example of allocating a 10% turn-on duty to a 40% turn-on pattern will be explained below. The amount of power required in the full turn-on for 1 half-wavelength equivalent to the 10% turn-on duty, as shown in FIG. 5A, is calculated by Equation (1). In Equation (1), v represents an effective value of AC power supply voltage, and a, b represent zero-cross timing. θ (rad) is a phase angle at which the sine wave crosses through zero at time a and b.

$$\int_a^b v \times \sqrt{2} \times \sin\theta d\theta \quad (1)$$

When a partial turn-on is allocated to the 40% turn-on pattern, as shown in FIG. 5B, four partial turn-ons are allocated to the turn-on pattern. If periods of the four partial turn-ons are set as c-d, e-f, g-h, and i-j, then the sum of turn-on power of the four partial turn-ons is calculated by Equation (2). Therefore, in order to make the sum of amounts of turn-on power set from the turn-on duty determined by the turn-on duty decision unit 113 equal to the sum of turn-on power required for a plurality of partial turn-ons allocated to the turn-on pattern, the periods are simply set so that the amount of power in Equation (1) and the amount of power in Equation (2) become equal to each other.

$$\int_c^d v\times\sqrt{2}\times\sin\theta d\theta+\int_e^f v\times\sqrt{2}\times\sin\theta d\theta+\int_g^h v\times\sqrt{2}\times\sin\theta d\theta+\int_i^j v\times\sqrt{2}\times\sin\theta d\theta \quad (2)$$

Moreover, in the present embodiment, each of the periods is set so that the four partial turn-on periods shown in FIG. 5B are equal to each other.

As explained above, the image forming apparatus 10 according to the present embodiment achieves the turn-on power set by the turn-on duty determined by the turn-on duty decision unit 113 while increasing the number of turn-ons per control period, and thus, a desired power supply can be maintained.

Furthermore, in the present embodiment, if the partial turn-ons of which periods are equal to each other or uniform partial turn-ons are allocated, and if the amount of turn-on power of each of the partial turn-ons is made constant, then there does not occur a difference in voltage drop during continuous turn-on. Therefore, voltage fluctuation can be prevented, and a flicker level can be improved. Moreover, by making the periods of the partial turn-ons equal to each other, the control can be simplified.

As explained above, according to the image forming apparatus 10 of the first embodiment, when the determined turn-on duty is low, by allocating a turn-on required for the turn-on duty, as a partial turn-on, to the turn-on pattern which is set so as to avoid flicker, the flicker level can be improved while preventing the level of the harmonic current and the noise terminal voltage from being lowered.

In the phase control in which a turn-on is allocated to a part of the half-wavelength, there arises a problem that the level of the harmonic current and the noise terminal voltage is worsened. On the other hand, in the present embodiment, the number of phase controls is thinned out so as to perform phase control on, for example, only periods of the full turn-ons in the 40% turn-on pattern. Therefore, it is possible to prevent the level of the harmonic current and the noise terminal voltage from being worsened.

Figure 6:
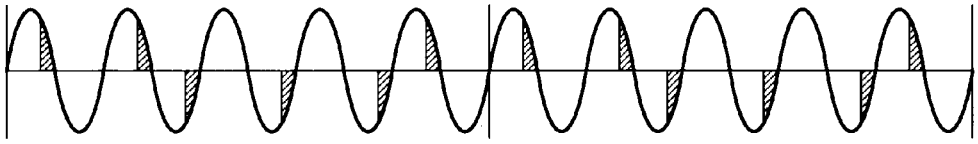
FIG. 6 is a diagram representing one example of a 60% turn-on pattern to which partial turn-ons are allocated.

A first modification of the present embodiment will be explained below. In the image forming apparatus 10 according to the present embodiment, if the turn-on duty determined by the turn-on duty decision unit 113 is 30% or less, the turn-on pattern allocated with the partial turn-on is set to the 40% turn-on pattern, however, it may be set to a 60% turn-on pattern instead. FIG. 6 is a diagram of a turn-on pattern in which partial turn-ons equivalent to a 10% turn-on duty per 1 half-wavelength is allocated to a 60% turn-on pattern.

The 60% turn-on pattern has a high ratio of the turn-on as compared with that of the 40% turn-on pattern. Therefore, the inrush current can be reduced although the level of the harmonic current and the noise terminal voltage is worsened. Therefore, it is preferable to set which of 40% and 60% turn-on patterns is to be extracted, based on characteristics of the apparatus and the like.

For example, if the rated power of the halogen heater 121 is relatively large and improvement of the flicker level is preferred, then it is preferable that the number of turn-ons be increased and a power supply per turn-on be reduced. Therefore, in this case, it is effective to use the 60% turn-on pattern.

Meanwhile, if the rated power of the halogen heater 121 is relatively small and prevention of level worsening of the harmonic current and the noise terminal voltage is preferred, then it is preferable that the number of turn-ons be decreased and the number of phase controls be reduced. Therefore, in this case, it is effective to use the 40% turn-on pattern.

As a second modification, if the turn-on duty determined by the turn-on duty decision unit 113 is 30% or less which is the threshold, the turn-on pattern extraction unit 114 may extract different turn-on patterns to be allocated with partial turn-ons depending on the determined turn-on duty. For example, if the turn-on duty is determined as 10%, the turn-on pattern extraction unit 114 may extract the 40% turn-on pattern, while if the turn-on duty is determined as 20%, the turn-on pattern extraction unit 114 may extract the 60% turn-on pattern. Conversely, if the turn-on duties are determined as 10% and 20%, then the 60% and 40% turn-on patterns may be extracted respectively.

Figure 7:
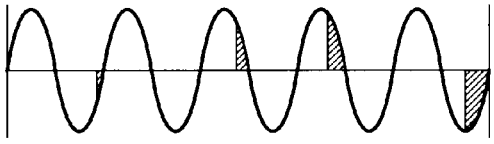
FIG. 7 is a diagram representing one example of a turn-on pattern to which partial turn-ons are allocated.

As a third modification, the partial turn-on allocation unit 115 may make amounts of power of a plurality of partial turn-ons allocated to the determined turn-on pattern different from each other. For example, as shown in FIG. 7, the partial turn-on allocation unit 115 may allocate a plurality of partial turn-ons so that the turn-on power is getting large from the head to the end of the turn-on pattern. Thus, voltage fluctuations upon turn-on of the halogen heater 121 can be prevented.

Figure 8:
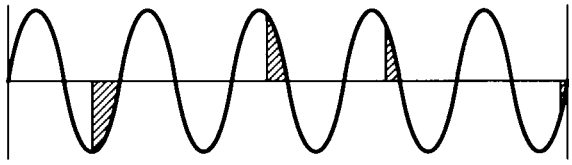
FIG. 8 is a diagram representing one example of the turn-on pattern to which partial turn-ons are allocated.

As another example, as shown in FIG. 8, the partial turn-on allocation unit 115 may allocate a plurality of partial turn-ons so that the turn-on power is getting small from the head to the end of the turn-on pattern. Thus, voltage fluctuations upon turn-off of the halogen heater 121 can be prevented.

Figure 9:
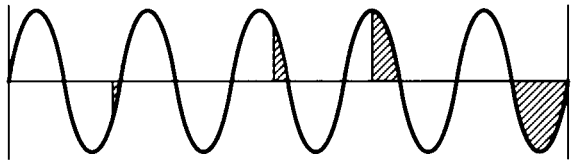
FIG. 9 is a diagram representing one example of the turn-on pattern to which partial turn-ons are allocated.
Figure 10:
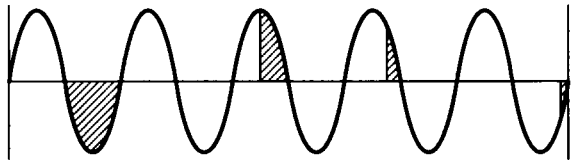
FIG. 10 is a diagram representing one example of the turn-on pattern to which partial turn-ons are allocated.

As another example, as shown in FIG. 9 or FIG. 10, the partial turn-on allocation unit 115 may allocate not only the partial turn-on but also the full turn-on. Thus, even when the amounts of power of the partial turn-ons are made different from each other, each period of the partial turn-ons is determined so that the sum of the amounts of turn-on power of the partial turn-ons allocated to the turn-on pattern becomes equal to the amount of power set by the determined duty.

As a fourth modification, the partial turn-on allocation unit 115 allocates a turn-on pattern such that the turn-on power gradually increases, as shown in FIG. 7 in a fixed period after the turn-on of the halogen heater 121 is started, as a comparatively long-term control. Thereafter, the partial turn-on allocation unit 115 may allocate a turn-on pattern of fixed turn-on power as shown in FIG. 4 and FIG. 6, and may allocate a turn-on pattern such that the turn-on power gradually decreases, as shown in FIG. 8, in a fixed period before the halogen heater 121 is turned off.

(Second Embodiment)

Figure 11:
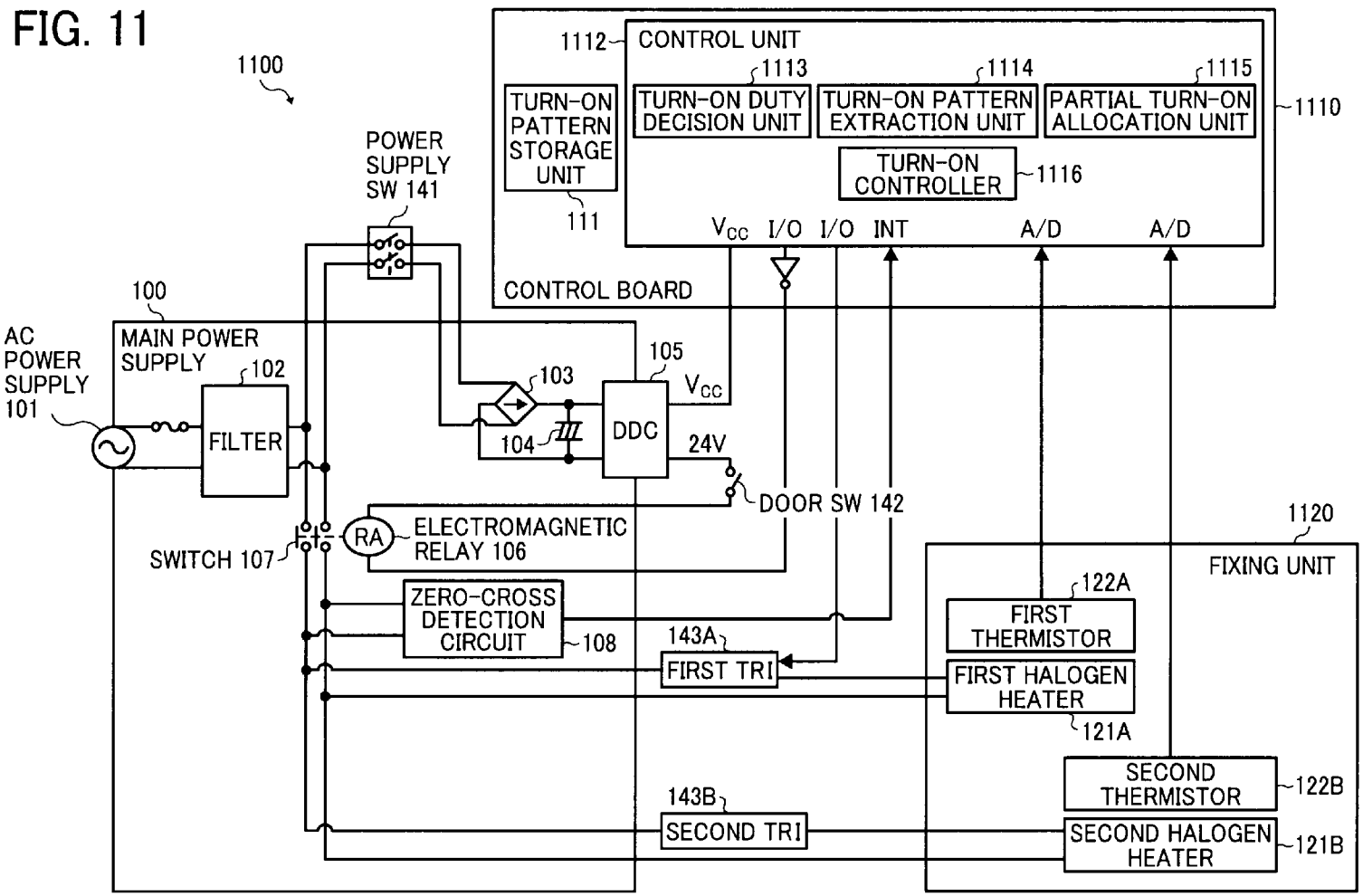
FIG. 11 is a block diagram of an entire configuration of an image forming apparatus according to a second embodiment.

FIG. 11 is a block diagram of an entire configuration of an image forming apparatus 1100 according to a second embodiment. The image forming apparatus 1100 includes the heater control device for controlling a heater in a fixing unit or the like provided in the image forming apparatus 1100. More specifically, the image forming apparatus 1100 mainly includes the main power supply 100 and a control board 1110. The image forming apparatus 1100 further includes a fixing unit 1120, the power supply SW 141, and the door SW 142.

The fixing unit 1120 includes two halogen heaters: a first halogen heater 121A and a second halogen heater 121B. The fixing unit 1120 further includes a first thermistor 122A and a second thermistor 122B provided near the first halogen heater 121A and the second halogen heater 121B, respectively. The amount of turn-on power of the first halogen heater 121A is equal to that of the second halogen heater 121B.

The control board 1110 controls the entire image forming apparatus 1100. The control board 1110 is implemented as a computer including a CPU, a RAM, a ROM, a NVRAM, an ASIC (Application Specific Integrated Circuit) (not shown), and an I/O interface, which are connected to each other via a bus.

The control board 1110 controls on/off of two triacs: first triac (TRI) 143A and a second TRI 143B, and the electromagnetic relay 106 internally provided in the main power supply 100, to control temperature and on/off of the first halogen heater 121A and the second halogen heater 121B of the fixing unit 1120. Any other heaters such as a ceramic heater may be used instead of the first halogen heater 121A and the second halogen heater 121B.

The first thermistor 122A provided near the first halogen heater 121A detects a surface temperature of a heated object of the first halogen heater 121A. Likewise, the second thermistor 122B provided near the second halogen heater 121B detects a surface temperature of a heated object of the second halogen heater 121B. The control board 1110 performs A/D conversion on the surface temperature detected by the first thermistor 122A, to detect the surface temperature of the heated object of the first halogen heater 121A. Likewise, the control board 1110 performs A/D conversion on the surface temperature detected by the second thermistor 122B, to detect the surface temperature of the heated object of the second halogen heater 121B. The control board 1110 controls on/off of the first TRI 143A and the second TRI 143B and of the electromagnetic relay 106 so that the surface temperature of the heated object of the first halogen heater 121A and the surface temperature of the heated object of the second halogen heater 121B are stabilized.

Here, the functions and operations of the power supply SW 141, the AC power supply 101, the filter 102, the rectifier diode 103, the smoothing capacitor 104, the DDC 105, the electromagnetic relay 106, the switch 107, and the door SW 142 are the same as these of the first embodiment.

The zero-cross detection circuit 108, similarly to the first embodiment, detects a zero cross point of the AC power supply 101, and the control board 1110 turns on/off the first TRI 143A and the second TRI 143B according to the zero cross point.

The control board 1110 includes the turn-on pattern storage unit 111 and a control unit 1112. The control unit 1112 performs thinning control for controlling on/off of energization to the first halogen heater 121A and the second halogen heater 121B using a half-wavelength of the alternating current voltage as one unit. The control unit 1112 also performs thinning-phase control as a combination of phase control, in which only a part of the half-wavelength is turned on, and the thinning control. The thinning-phase control will be explained later. The control unit 1112 controls specifically turn-on of the first halogen heater 121A and of the second halogen heater 121B according to the turn-on patterns stored in the turn-on pattern storage unit 111.

The turn-on pattern storage unit 111, similarly to the first embodiment, stores therein turn-on patterns. The turn-on patterns are those of the first halogen heater 121A and the second halogen heater 121B on a control-period basis. That is, the turn-on patterns stored in the turn-on pattern storage unit 111 are used for heater control of both the first halogen heater 121A and the second halogen heater 121B. The turn-on patterns of the present embodiment are associated with turn-on duties which are turn-on ratios of the first halogen heater 121A and the second halogen heater 121B, and are similar to these of the first embodiment as shown in FIG. 2.

The control unit 1112 in FIG. 11 includes a turn-on duty decision unit 1113, a turn-on pattern extraction unit 1114, a partial turn-on allocation unit 1115, and a turn-on controller 1116. The turn-on duty decision unit 1113 determines a turn-on duty of the first halogen heater 121A based on a surface temperature of the heated object of the first halogen heater 121A detected by the first thermistor 122A and also based on a target temperature. The turn-on duty decision unit 1113 also determines a turn-on duty of the second halogen heater 121B based on a surface temperature of the heated object of the second halogen heater 121B detected by the second thermistor 122B and also based on a target temperature.

Here, the turn-on pattern extraction unit 1114, the partial turn-on allocation unit 1115, and the turn-on pattern storage unit 111 function as a turn-on pattern decision unit.

The turn-on pattern extraction unit 1114 determines whether the sum of turn-on duties of the first halogen heater 121A and the second halogen heater 121B is equal to or less than a first threshold. If it is equal to or less than the first threshold, then it is further determined whether one of the turn-on duties of the first halogen heater 121A and the second halogen heater 121B is 0%. When the sum of turn-on duties of the first halogen heater 121A and the second halogen heater 121B is equal to or less than the first threshold and both of them are not 0%, then the turn-on pattern extraction unit 1114 extracts two turn-on patterns, from the turn-on pattern storage unit 111, which are associated with turn-on duties higher than the turn-on duties determined by the turn-on duty decision unit 1113 and in which the second halogen heater 121B is turned off when the first halogen heater 121A is turned on.

The turn-on pattern extraction unit 1114, when the sum of the turn-on duties of the first halogen heater 121A and the second halogen heater 121B is higher than the first threshold, further determines whether the sum of the turn-on duties is equal to or less than a second threshold. When the sum of the turn-on duties of the first halogen heater 121A and the second halogen heater 121B is higher than the first threshold and is equal to or less than the second threshold, the turn-on pattern extraction unit 1114 extracts two turn-on patterns, from the turn-on pattern storage unit 111, in which the total of the turn-on duties of the first halogen heater 121A and the second halogen heater 121B is 100%, which are associated with turn-on duties higher than the turn-on duties determined by the turn-on duty decision unit 1113, and in which the second halogen heater 121B is turned off when the first halogen heater 121A is turned on.

Furthermore, the turn-on pattern extraction unit 1114, when the sum of the turn-on duties of the first halogen heater 121A and the second halogen heater 121B is higher than the first threshold and is higher than the second threshold, extracts two turn-on patterns corresponding to the turn-on duties determined by the turn-on duty decision unit 1113 from the turn-on pattern storage unit 111, and thereby determines the turn-on patterns corresponding to the determined turn-on duties using the control period as a unit, as the turn-on patterns of the first halogen heater 121A and of the second halogen heater 121B.

The partial turn-on allocation unit 1115, when the turn-on pattern extraction unit 1114 extracts turn-on patterns associated with turn-on duties higher than the turn-on duties determined by the turn-on duty decision unit 1113 from the turn-on pattern storage unit 111, allocates partial turn-ons of the first halogen heater 121A and the second halogen heater 121B, instead of the full turn-ons, to the half-wavelengths allocated with the full turn-ons in the turn-on patterns extracted by the turn-on pattern extraction unit 1114. As a result, the partial turn-ons are determined as the turn-on patterns of the first halogen heater 121A and the second halogen heater 121B. Here, the partial turn-on is used to turn on the first halogen heater 121A and the second halogen heater 121B for only a part of the period of the half-wavelength. That is, the partial turn-on is a control to change a phase of the alternating current voltage supplied to each of the first halogen heater 121A and the second halogen heater 121B.

The turn-on patterns obtained by the partial turn-on allocation unit 1115 are patterns (partial turn-on patterns) in which the partial turn-ons are allocated to the thinning patterns, and the turn-on control of the first halogen heater 121A and the second halogen heater 121B using these turn-on patterns is referred to as "thinning-phase control".

The turn-on controller 1116 controls the turn-ons of the first halogen heater 121A and the second halogen heater 121B based on the turn-on patterns extracted by the turn-on pattern extraction unit 1114 or based on the turn-on patterns allocated with the partial turn-ons by the partial turn-on allocation unit 1115.

Figure 12:
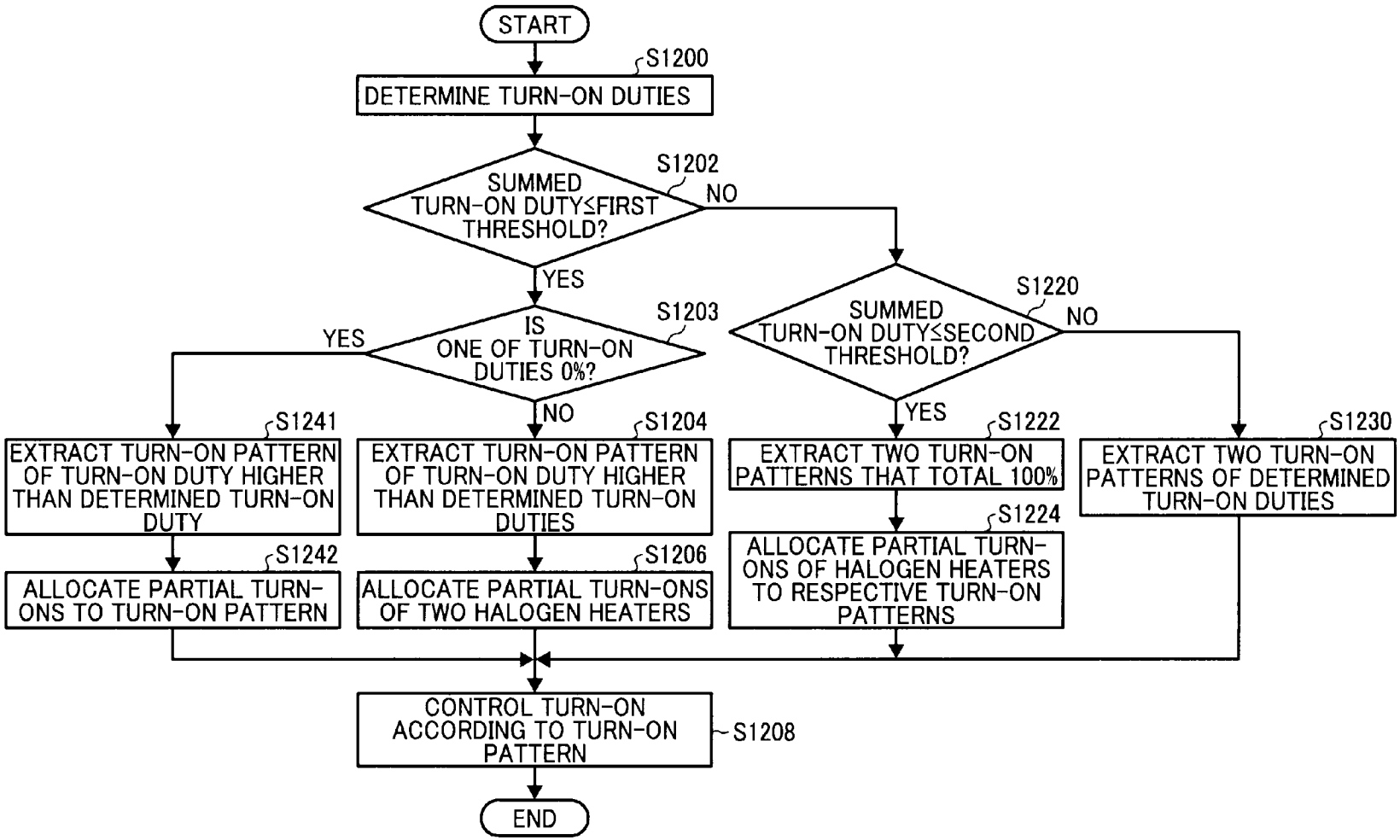
FIG. 12 is a flowchart of a heater control process performed by the image forming apparatus according to the second embodiment.

FIG. 12 is a flowchart of a heater control process performed by the image forming apparatus 1100. First, the turn-on duty decision unit 1113 determines turn-on duties of the first halogen heater 121A and the second halogen heater 121B (Step S1200).

Next, the turn-on pattern extraction unit 1114 determines whether a turn-on duty obtained by summing the turn-on duty of the first halogen heater 121A and the turn-on duty of the second halogen heater 121B determined by the turn-on duty decision unit 1113 is equal to or less than the first threshold (Step S1202).

Then, if the summed turn-on duty is equal to or less than the first threshold (Yes at Step S1202), then the turn-on pattern extraction unit 1114 further determines whether one of the turn-on duty of the first halogen heater 121A and the turn-on duty of the second halogen heater 121B is 0% (Step S1203).

When both the turn-on duty of the first halogen heater 121A and the turn-on duty of the second halogen heater 121B are not 0% (No at Step S1203), then the turn-on pattern extraction unit 1114 extracts a turn-on pattern of a turn-on duty higher than the determined turn-on duties (Step S1204).

For example, in a case where the first threshold is 20%, if both the turn-on duties of the first halogen heater 121A and the second halogen heater 121B determined at Step S1200 are 10%, then the turn-on pattern extraction unit 1114 extracts a turn-on pattern associated with a turn-on duty of 60% from the turn-on pattern storage unit 111.

Next, the partial turn-on allocation unit 1115 allocates partial turn-ons of the first halogen heater 121A and the second halogen heater 121B, instead of full turn-ons, to the half-wavelengths allocated with the full turn-ons of the turn-on pattern extracted by the turn-on pattern extraction unit 1114 (Step S1206). Next, the turn-on controller 1116 controls the turn-ons of the first halogen heater 121A and the second halogen heater 121B according to the turn-on pattern to which the partial turn-ons are allocated by the partial turn-on allocation unit 1115 (Step S1208).

Figure 13:
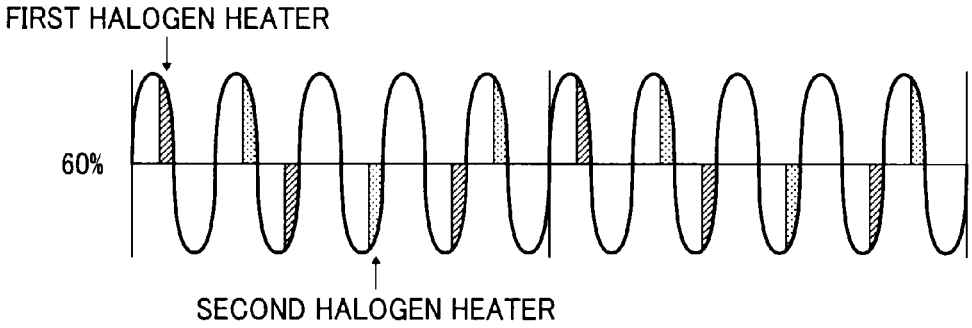
FIG. 13 is a diagram representing one example of a 60% turn-on pattern to which partial turn-ons are allocated by a partial turn-on allocation unit according to the second embodiment.

FIG. 13 is a diagram representing a 60% turn-on pattern to which partial turn-ons are allocated by the partial turn-on allocation unit 1115 in a partial allocation process (Step S1206). The partial turn-on allocation unit 1115 alternately allocates partial turn-ons of the first halogen heater 121A and partial turn-ons of the second halogen heater 121B, instead of the full turn-ons, to the half-wavelengths of the full turn-ons included in the 60% turn-on pattern. As a result, the partial turn-ons of the first halogen heater 121A and the second halogen heater 121B are allocated to 3 half-wavelengths in one control period, respectively.

Moreover, the partial turn-on allocation unit 1115 sets a ratio of turn-ons in half-wavelengths so that the sum of turn-on power required for a plurality of partial turn-ons of the first halogen heater 121A allocated to the turn-on pattern becomes equal to the sum of turn-on power set by the turn-on duty of the first halogen heater 121A determined by the turn-on duty decision unit 1113. Furthermore, it is set so that the values of turn-on power in the partial turn-ons of the first halogen heater 121A are equal to each other. The same goes for the partial turn-ons of the second halogen heater 121B.

As another example, setting may be made so that the values of turn-on power in the partial turn-ons are different from each other. In this case, also, the sum of the amounts of turn-on power required for the partial turn-ons is preferably set so as to be equal to the sum of the turn-on power set by the turn-on duties.

When the turn-on duty is low, each period during which the first halogen heater 121A and the second halogen heater 121B are on within the control period becomes short. Therefore, if the turn-on control is performed using the turn-on pattern stored in the turn-on pattern storage unit 111, there arises a problem that inrush current caused by continuation of the turn-off period is increased.

On the other hand, the image forming apparatus 1100 according to the present embodiment is configured to reduce the turn-off period by dividing a turn-on for 1 or 2 or more of half-wavelengths set by the turn-on duty into partial turn-ons in a plurality of half-wavelengths and by allocating the partial turn-ons within the control period. Moreover, it is configured that the half-wavelength allocated with the partial turn-on follows the turn-on pattern stored in the turn-on pattern storage unit 111. Thus, an increase in the inrush current can be prevented and flicker can be reduced.

In the phase control that allocates a turn-on to a part of the half-wavelength, there arises a problem that the level of the harmonic current and the noise terminal voltage is worsened. In contrast, in the present embodiment, the number of phase controls is thinned out so as to perform the phase control only on a period of full turn-on in the 60% turn-on pattern, for example. Therefore, it is possible to suppress worsening of the level of the harmonic current and the noise terminal voltage.

In the present embodiment, the turn-on pattern extracted by the turn-on pattern extraction unit 1114 at Step S1204 is set to the 60% turn-on pattern which is relatively excellent in frequency characteristics, however, it is not limited to the 60% turn-on pattern. Thus, it may be a turn-on pattern of other turn-on duty. However, it is preferably a turn-on pattern being three or more times as high as the determined turn-on duty.

Referring back to Step S1203, if one of the turn-on duty of the first halogen heater 121A and the turn-on duty of the second halogen heater 121B is 0% (Yes at Step S1203), the turn-on pattern extraction unit 1114 extracts a turn-on pattern of a turn-on duty higher than the determined turn-on duty of the halogen heater in which the turn-on duty is not 0% (Step S1241). For example, in the present embodiment, the 40% turn-on pattern is extracted. Next, the partial turn-on allocation unit 1115 allocates partial turn-ons to half-wavelengths allocated with the full turn-ons of the turn-on pattern extracted by the turn-on pattern extraction unit 1114 (Step S1242). Next, the turn-on controller 1116 controls the turn-ons of the halogen heaters according to the turn-on pattern to which the partial turn-ons are allocated by the partial turn-on allocation unit 1115 (Step S1208).

Referring back to Step S1202, if the turn-on duty obtained by summing the turn-on duty of the first halogen heater 121A and the turn-on duty of the second halogen heater 121B determined by the turn-on duty decision unit 1113 is higher than the first threshold (No at Step S1202), then the turn-on pattern extraction unit 1114 further determines whether the summed turn-on duty is equal to or less than the second threshold (Step S1220).

If the summed turn-on duty is equal to or less than the second threshold (Yes at Step S1220), then the turn-on pattern extraction unit 1114 extracts turn-on patterns of the turn-on duties that total 100% from the turn-on pattern storage unit 111 (Step S1222). The partial turn-on allocation unit 1115 allocates partial turn-ons of the first halogen heater 121A and the second halogen heater 121B to the turn-on patterns, respectively (Step S1224). Next, the turn-on controller 1116 controls the turn-ons of the first halogen heater 121A and the second halogen heater 121B according to the turn-on patterns to which the partial turn-ons are allocated by the partial turn-on allocation unit 1115 (Step S1208).

For example, it is assumed that the second threshold is set to 30% and, at Step 51200, one of the turn-on duties of the first halogen heater 121A and the second halogen heater 121B is determined as 10% and the other turn-on duty is determined as 20%. In this case (No at Step S1202, Yes at Step S1220), at Step S1222, the turn-on pattern extraction unit 1114 extracts a turn-on pattern associated with the turn-on duty of 40% and a turn-on pattern associated with the turn-on duty of 60% as turn-on duties that total 100% from the turn-on pattern storage unit 111. Then, at Step S1224, the partial turn-on allocation unit 1115 allocates partial turn-ons of the halogen heater (the first halogen heater 121A or the second halogen heater 121B), for which the turn-on duty of 20% is determined instead of the full turn-ons, to the half-wavelengths of the full turn-ons included in the 40% turn-on pattern. Furthermore, the partial turn-on allocation unit 1115 allocates partial turn-ons of the halogen heater (the first halogen heater 121A or the second halogen heater 121B), for which the turn-on duty of 10% is determined instead of the full turn-ons, to the half-wavelengths of the full turn-ons included in the 60% turn-on pattern (Step S1224).

Figure 14:
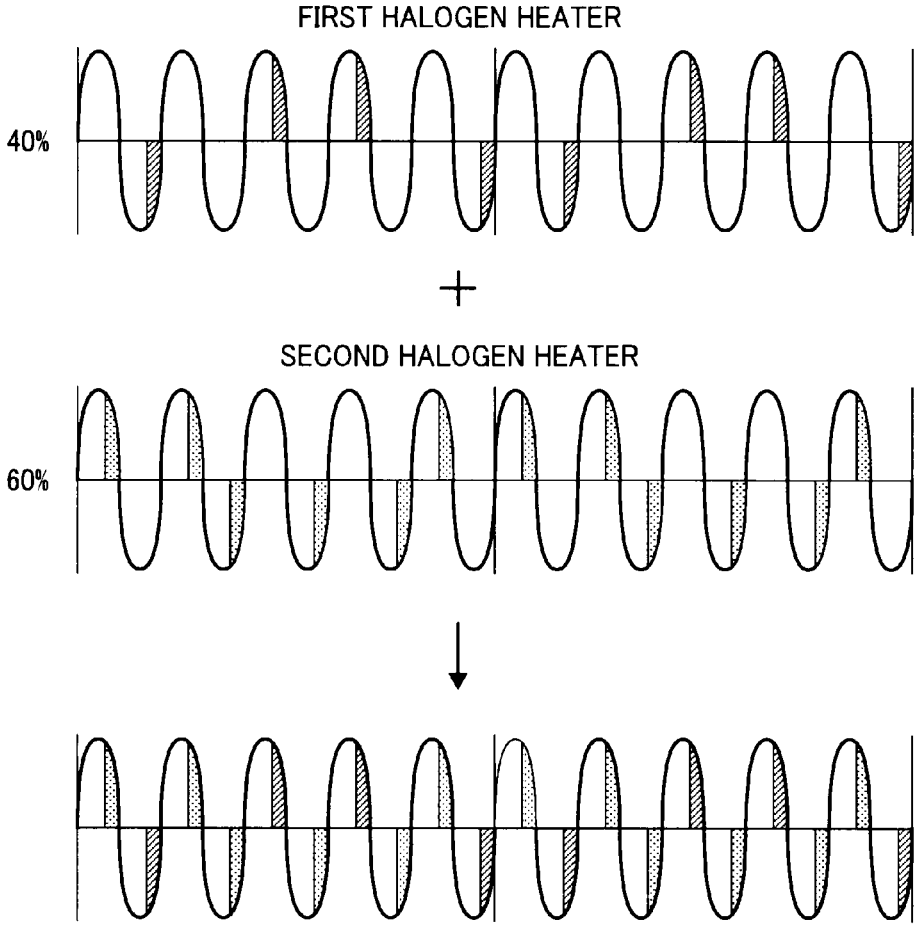
FIG. 14 is a diagram representing one example of turn-on patterns to which partial turn-ons are allocated by the partial turn-on allocation unit according to the second embodiment.

FIG. 14 is a diagram representing turn-on patterns to which partial turn-ons are allocated by the partial turn-on allocation unit 1115 in a partial turn-on allocation process (Step S1224). The turn-on patterns shown in FIG. 14 are those when the turn-on duty of the first halogen heater 121A is determined as 10% and the turn-on duty of the second halogen heater 121B is determined as 20%.

As shown in the upper and middle patterns of FIG. 14, the partial turn-on allocation unit 1115 first allocates the partial turn-ons of the first halogen heater 121A to the 40% turn-on pattern and then allocates the partial turn-ons of the second halogen heater 121B to the 60% turn-on pattern. In this case, also, as already explained, the partial turn-on allocation unit 1115 allocates the partial turn-ons to the 40% turn-on pattern so that the sum of the amounts of turn-on power required for a plurality of partial turn-ons within the control period of the first halogen heater 121A becomes equal to the amount of turn-on power set from the turn-on duty (10%) of the first halogen heater 121A determined by the turn-on duty decision unit 1113, and so that the amounts of power of the partial turn-ons are equal to each other. The same goes for allocation of the partial turn-ons of the second halogen heater 121B to the 60% turn-on pattern.

Thus, the partial turn-ons of the first halogen heater 121A are allocated to 4 half-wavelengths included in the 40% turn-on pattern. Also, the partial turn-ons of the second halogen heater 121B are allocated to 6 half-wavelengths included in the 60% turn-on pattern.

At Step S1208 in FIG. 12, the turn-on controller 1116 controls the turn-ons of the first halogen heater 121A and the second halogen heater 121B using the turn-on pattern in which the two turn-on patterns obtained through the partial turn-on allocation process (Step S1224) are superimposed on each other, as shown in the lower pattern of FIG. 14 (Step S1208).

The turn-on patterns stored in the turn-on pattern storage unit 111 according to the present embodiment have a relationship such that the full turn-ons and full turn-offs of the two turn-on patterns, which are added to become 100% like 40% and 60%, and 30% and 70%, are opposite to each other at the turn-on duty of 50%. Therefore, in the turn-on control of the first halogen heater 121A and the second halogen heater 121B using the turn-on pattern in which the 40% and 60% turn-on patterns are superimposed on each other, the second halogen heater 121B is turned off when the first halogen heater 121A is turned on.

Therefore, as explained above, by using the 40% and 60% turn-on patterns for the two first halogen heater 121A and second halogen heater 121B, it is possible to avoid simultaneous turn-ons of the first halogen heater 121A and the second halogen heater 121B, which allows an increase in inrush current to be prevented and flicker to be reduced.

When the sum of the turn-on duties of the two first halogen heater 121A and second halogen heater 121B is 30% and if the partial turn-ons of the two first halogen heater 121A and second halogen heater 121B are allocated to the 60% turn-on pattern as shown in FIG. 13, the phase angle is 90 degrees, which becomes so large that the inrush current is not negligible. Therefore, in the present embodiment, when the sum of the turn-on duties of the two first halogen heater 121A and second halogen heater 121B is 30%, the number of phase controls is increased by using the two 40% and 60% turn-on patterns in the above manner, so that the phase angle is made small. This allows two kinds of power for execution of the half wave cycles in the turn-on pattern used for turn-on control, and thus it is possible to perform control favorable to flicker with a small potential difference as compared with the case in which only one halogen heater is turned on.

Moreover, when the turn-on duties of the two first halogen heater 121A and second halogen heater 121B are different from each other in the above manner, by allocating a turn-on pattern of a higher turn-on duty to the halogen heater having a high turn-on duty, the amounts of power of the partial turn-ons can be made constant, which allows voltage fluctuations during continuous turn-on to be prevented and the flicker level to be improved.

As another example, the turn-on pattern selected by the turn-on pattern extraction unit 1114 is not limited to the 40% and 60% turn-on patterns, and thus may be a turn-on pattern of other turn-on duty. However, as explained above, it is preferable to extract two turn-on patterns having different turn-on timings in terms of prevention of the inrush current from being increased.

Referring back to Step S1220, if the turn-on duty obtained by summing the turn-on duty of the first halogen heater 121A and the turn-on duty of the second halogen heater 121B determined by the turn-on duty decision unit 1113 is higher than the second threshold (No at Step S1220), then the turn-on pattern extraction unit 1114 reads the turn-on patterns of the turn-on duties determined for the first halogen heater 121A and second halogen heater 121B from the turn-on pattern storage unit 111 (Step S1230). The turn-on controller 1116 controls the turn-ons of the first halogen heater 121A and the second halogen heater 121B according to the turn-on patterns extracted by the turn-on pattern extraction unit 1114 (Step S1208).

For example, when the sum of the turn-on duties of the two first halogen heater 121A and second halogen heater 121B determined at Step S1200 is higher than 30%, specifically, when it is obtained from any combination other than a combination of 10% and 10% or of 10% and 20% (No at Step S1202 and No at Step S1220), at Step S1230, the turn-on pattern extraction unit 1114 extracts a turn-on pattern, for the first halogen heater 121A, associated with the turn-on duty of the first halogen heater 121A determined by the turn-on duty decision unit 1113 from the turn-on pattern storage unit 111. The turn-on pattern extraction unit 1114 further extracts a turn-on pattern, for the second halogen heater 121B, associated with the turn-on duty of the second halogen heater 121B determined by the turn-on duty decision unit 1113 from the turn-on pattern storage unit 111.

As explained above, the image forming apparatus 1100 according to the present embodiment, when the sum of the turn-on duties of the two first halogen heater 121A and second halogen heater 121B is equal to or less than the threshold, performs the thinning-phase control, and the flicker level can thereby be improved while preventing the level of the harmonic current and the noise terminal voltage from being worsened. Moreover, it is possible to control so that turn-on timings of the two first halogen heater 121A and second halogen heater 121B do not synchronize, and thus an increase in the inrush current can be prevented.

A first modification of the present embodiment will be explained. In the present embodiment, if both the turn-on duties of the two first halogen heater 121A and second halogen heater 121B are 10%, the partial turn-ons of the two first halogen heater 121A and second halogen heater 121B are allocated to one turn-on pattern, and if the turn-on duty of one of the two first halogen heater 121A and second halogen heater 121B is 10% and the turn-on duty of the other halogen heater is 20%, the partial turn-ons of the halogen heaters are allocated to the two turn-on patterns respectively. However, instead of this, even if one of the turn-on duties is 10% and the other is 20%, the partial turn-ons of the two first halogen heater 121A and second halogen heater 121B may be allocated to one turn-on pattern. As another example, even if both of the turn-on duties are 10%, two turn-on patterns may be extracted and the partial turn-ons of each of the halogen heaters may be allocated to each of the turn-on patterns.

Thus, when the sum of the turn-on duties of the two first halogen heater 121A and second halogen heater 121B is equal to or less than the threshold, the turn-ons of the two halogen heaters are simply controlled based on the turn-on pattern in which the partial turn-ons of the two first halogen heater 121A and second halogen heater 121B are allocated to the half-wavelengths so as to avoid flicker during the control period. Therefore, the turn-on pattern decision method is not limited to the embodiment.

Furthermore, as a second modification, there is no need to include the turn-on pattern storage unit 111 and the turn-on pattern extraction unit 1114. In this case, the turn-on controller 1116 generates a turn-on pattern of each of the turn-on duties so that flicker is avoided, and simply allocates partial turn-ons to the turn-on pattern.

As a third modification, the image forming apparatus 1100 may be provided with only one halogen heater. In this case, only one thermistor and TRI are simply provided accordingly. Thus, when only one halogen heater is provided, the turn-on duty decision unit 1113 determines a turn-on duty of only one halogen heater. The turn-on pattern extraction unit 1114, when the determined turn-on duty is equal to or less than the threshold, extracts a turn-on pattern associated with a turn-on duty higher than the determined turn-on duty. The partial turn-on allocation unit 1115 allocates the partial turn-ons instead of the full turn-ons to the half-wavelengths of the full turn-ons included in the turn-on pattern extracted by the turn-on pattern extraction unit 1114. The turn-on controller 1116 controls turn-on of the halogen heater according to the turn-on pattern allocated with the partial turn-ons by the partial turn-on allocation unit 1115.

(Third Embodiment)

Next, an image forming apparatus 1100 according to a third embodiment will be explained below. The configuration of the image forming apparatus 1100 according to the third embodiment is the same as that of the image forming apparatus 1100 according to the second embodiment. However, the amounts of turn-on power of the two first halogen heater 121A and second halogen heater 121B in the image forming apparatus 1100 according to the third embodiment are different from each other. In the present embodiment, the amount of turn-on power of the first halogen heater 121A is set to 500 watts, and the amount of turn-on power of the second halogen heater 121B is set to 700 watts.

Figure 15:
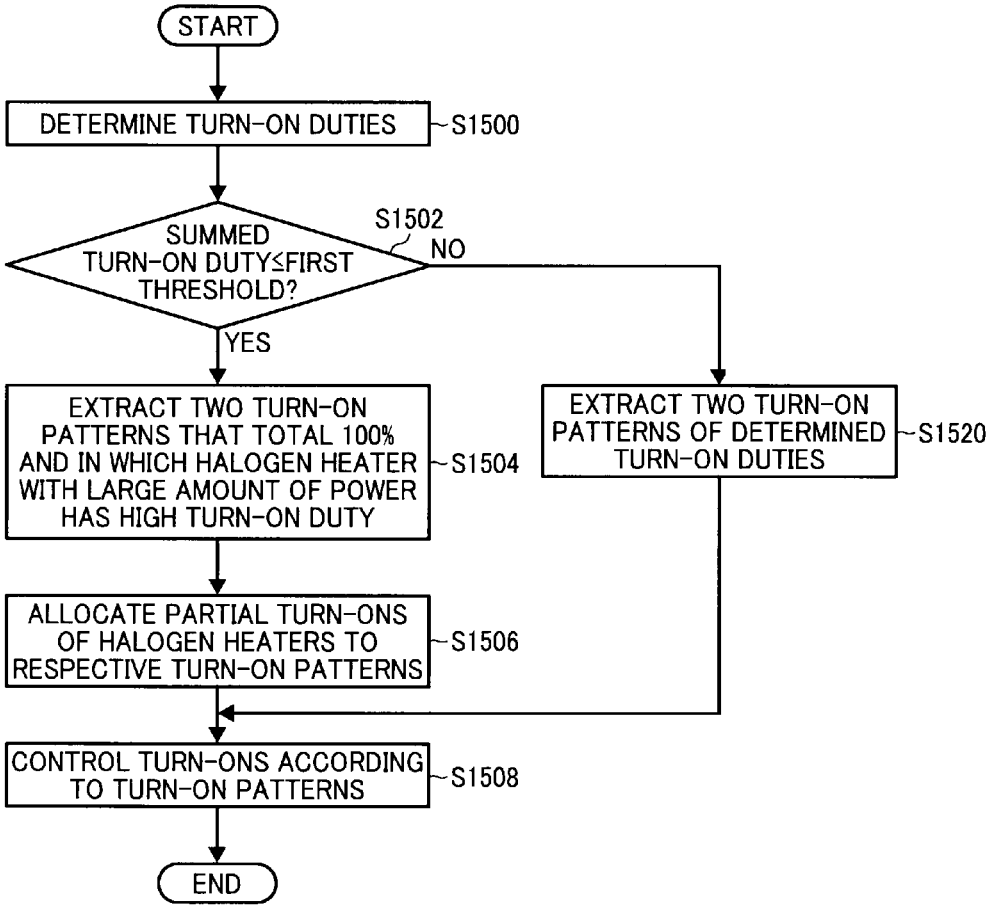
FIG. 15 is a flowchart of a heater control process according to a third embodiment.

FIG. 15 is a flowchart representing a heater control process performed by the image forming apparatus 1100 according to the third embodiment. First, the turn-on duty decision unit 1113 determines turn-on duties of the two first halogen heater 121A and second halogen heater 121B (Step S1500).

Next, the turn-on pattern extraction unit 1114 determines whether a turn-on duty obtained by summing the turn-on duty of the first halogen heater 121A and the turn-on duty of the second halogen heater 121B determined by the turn-on duty decision unit 1113 is equal to or less than a first threshold (Step S1502).

If the summed turn-on duty is equal to or less than the first threshold (Yes at Step S1502), then the turn-on pattern extraction unit 1114 extracts turn-on patterns of the turn-on duties that total 100% and in which the halogen heater with a large amount of turn-on power has a high turn-on duty, from the turn-on pattern storage unit 111 (Step S1504). The partial turn-on allocation unit 1115 allocates partial turn-ons of the first halogen heater 121A and the second halogen heater 121B to the turn-on patterns respectively (Step S1506). Next, the turn-on controller 1116 controls the turn-ons of the first halogen heater 121A and the second halogen heater 121B according to the turn-on patterns to which the partial turn-ons are allocated by the partial turn-on allocation unit 1115 (Step S1508).

For example, in a case where the first threshold is 20%, if both the turn-on duties of the two first halogen heater 121A and second halogen heater 121B are 10% (Yes at Step S1502), then the turn-on pattern extraction unit 1114 extracts the 40% turn-on pattern for the first halogen heater 121A from the turn-on pattern storage unit 111, and extracts the 60% turn-on pattern for the second halogen heater 121B which has a larger amount of turn-on power than that of the first halogen heater 121A, from the turn-on pattern storage unit 111. Thus, the turn-on pattern with a high turn-on duty is allocated to the halogen heater with the large amount of power.

It should be noted that the turn-on patterns obtained at Step S1506 are the same as the turn-on patterns shown in FIG. 14. That is, the 10% turn-on duty of the first halogen heater 121A is allocated to four partial turn-ons in one control period according to the 40% turn-on pattern as shown in FIG. 14. The 10% turn-on duty of the second halogen heater 121B with a large amount of turn-on power as compared with that of the first halogen heater 121A is allocated to six partial turn-ons in one control period according to the 60% turn-on pattern as shown in FIG. 14.

Thus, the turn-on pattern extraction unit 1114 allocates the turn-on pattern with a higher turn-on duty to the halogen heater with a larger amount of turn-on power. This allows achievement of control of high-frequency turn-on so as to prevent inrush current. Moreover, because the amounts of turn-on power of the partial turn-ons can be made constant, voltage fluctuations during continuous turn-on can be prevented and the flicker level can be improved.

Referring back to Step S1502, if the value obtained by summing the turn-on duties of the two first halogen heater 121A and second halogen heater 121B determined at Step S1500 is higher than the first threshold (for example, the summed value is 30% or more in the example that the first threshold is 20%) (No at Step S1502), the turn-on pattern extraction unit 1114 extracts a turn-on pattern, for the first halogen heater 121A, associated with the turn-on duty of the first halogen heater 121A determined by the turn-on duty decision unit 1113, and extracts a turn-on pattern, for second halogen heater 121B, associated with the turn-on duty of the second halogen heater 121B determined by the turn-on duty decision unit 1113 (Step S1520). The turn-on controller 1116 controls the turn-ons of the first halogen heater 121A and the second halogen heater 121B according to the respective turn-on patterns of the first halogen heater 121A and the second halogen heater 121B (Step S1508). At this point, the heater control process is completed.

The other configurations and processes of the image forming apparatus 1100 according to the third embodiment are the same as the configurations and operations of the image forming apparatus 1100 according to the second embodiment.

As a first modification of the third embodiment, a turn-on pattern allocated with partial turn-ons of each halogen heater may be selected not only based on a difference in amounts of power in the halogen heaters but also by adding the turn-on duties determined for the halogen heaters as explained in the second embodiment.

The first to third embodiments are configured to determine turn-on patterns by previously storing turn-on patterns indicating full turn-ons and full turn-offs on the half-wavelength basis in the turn-on pattern storage unit 111, extracting a turn-on pattern from the turn-on pattern storage unit 111 based on the determined turn-on duty, and allocating the partial turn-ons to the full turn-ons of the extracted turn-on pattern, however, the way to determine is not limited thereto. For example, it can be configured that the turn-on patterns indicating full turn-ons and full turn-offs on the half-wavelength basis are not stored previously, and that a turn-on pattern in which the partial turn-ons are allocated to the full turn-ons based on the determined turn-on duty is determined.

The image forming apparatuses 10 and 1100 according to the first to third embodiments include a control unit such as a CPU, a storage unit such as ROM and RAM, and an external storage device such as a HDD and a CD drive device, and implement a hardware configuration using an ordinary computer.

A heater control program executed in the image forming apparatuses 10 and 1100 according to the first to third embodiments is provided as a computer program product by being recorded in a computer-readable recording medium such as a CD-ROM, a flexible disk (FD), a CD-R, and a DVD (Digital Versatile Disk) in an installable format file or in an executable format file.

Moreover, the heater control program executed in the image forming apparatuses 10 and 1100 according to the first to third embodiments may be configured so that it is provided by storing the heater control program on a computer connected to a network such as the Internet and causing it to be downloaded through the network. Furthermore, the heater control program executed in the image forming apparatuses 10 and 1100 according to the first to third embodiments may be configured so that it is provided or distributed through the network such as the Internet. In addition, the heater control program executed in the image forming apparatuses 10 and 1100 according to the first to third embodiments may be configured so that it is provided by being previously installed in ROM or the like.

The heater control program executed in the image forming apparatuses 10 and 1100 according to the first to third embodiments is a module configuration including the units (the turn-on duty decision unit, the turn-on pattern extraction unit, the partial turn-on allocation unit, and the turn-on controller). As actual hardware, the CPU (processor) reads the heater control program from the recording medium and executes it, so that the units are loaded on a main storage unit and are generated on the main storage unit.

It should be noted that in the embodiments, the image forming apparatuses 10 and 1100 according to the present invention may be a multifunction product having at least two functions among a copy function, a printer function, a scanner function, and a facsimile function, and can be applied to any one of the image forming apparatuses such as a copier, a printer, a scanner device, a facsimile device, and the like.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. A heater control device comprising:

a temperature detector that detects a temperature of a heated object heated by a heater;

an alternating-current power supply for applying an alternating current voltage to the heater;

a turn-on ratio decision unit that determines a turn-on ratio of the heater based on the temperature and a target temperature;

a turn-on pattern decision unit that determines a partial turn-on pattern, as a turn-on pattern of the heater, which is a pattern of a turn-on ratio higher than determined turn-on ratio in terms of a control period, and to which a partial turn-on instead of a full turn-on is allocated on a half-wavelength basis of the alternating current voltage within the control period, based on the turn-on ratio of the heater; and a turn-on controller that controls turn-on of the heater based on determined turn-on pattern.

2. The heater control device according to claim 1, wherein the temperature detector detects temperatures of heated objects heated by a first heater and a second heater, the alternating-current power supply applies an alternating current voltage to the first heater and the second heater, the turn-on ratio decision unit determines a turn-on ratio of the first heater and a turn-on ratio of the second heater based on the temperatures and target temperatures, the turn-on pattern decision unit determines partial turn-on patterns, as a turn-on pattern of the first heater and a turn-on pattern of the second heater, which are patterns of turn-on ratios higher than determined turn-on ratios in terms of a control period, and to which partial turn-ons instead of full turn-ons are allocated on the half-wavelength basis of the alternating current voltage within the control period, based on the turn-on ratio of the first heater and the turn-on ratio of the second heater, and the turn-on controller controls turn-on of the first heater and turn-on of the second heater based on determined turn-on patterns.

3. The heater control device according to claim 1, wherein when the turn-on ratio of the heater is equal to or less than a threshold, the turn-on pattern decision unit determines the partial turn-on pattern, as the turn-on pattern of the heater, in which a sum of turn-on power of partial turn-ons is equal to a sum of turn-on power set from determined turn-on ratio.

4. The heater control device according to claim 3, wherein the turn-on pattern decision unit includes a turn-on pattern storage unit that stores therein the turn-on pattern, associated with the turn-on ratio, which is a pattern in terms of the control-period and in which a full turn-on or a full turn-off is allocated to a half-wavelength within the control period, a turn-on pattern extraction unit that, when the turn-on ratio of the heater is equal to or less than the threshold, extracts the turn-on pattern associated with the turn-on ratio higher than the determined turn-on ratio from the turn-on pattern storage unit, and a partial turn-on allocation unit that determines the partial turn-on pattern as the turn-on pattern of the heater, by allocating the partial turn-ons in which the sum of turn-on power of the partial turn-ons becomes the determined turn-on ratio to half-wavelengths allocated with full turn-ons, instead of the full turn-ons, of extracted turn-on pattern.

5. The heater control device according to claim 4, wherein the partial turn-on allocation unit allocates the partial turn-ons, of which values of turn-on power in a plurality of half-wavelengths are equal to each other, to the plurality of half-wavelengths.

6. The heater control device according to claim 4, wherein the partial turn-on allocation unit allocates the partial turn-ons, in which turn-on power of a plurality of half-wavelengths is gradually changed from a head to an end of the turn-on pattern, to the plurality of half-wavelengths.

7. The heater control device according to claim 4, wherein the turn-on pattern extraction unit extracts the turn-on pattern associated with the turn-on ratio higher than 40%.

8. The heater control device according to claim 4, wherein the partial turn-on allocation unit allocates the partial turn-ons such that the turn-on power increases during a first period of time from a start of turning on the heater, that the turn-on power decreases during a second period of time until turning off of the heater, and that values of the turn-on power become equal to each other during a period of time after passage of the first period of time and before passage of the second period of time.

9. The heater control device according to claim 2, wherein when a sum of the turn-on ratio of the first heater and the turn-on ratio of the second heater is equal to or less than a first threshold, the turn-on pattern decision unit determines the partial turn-on patterns, as the turn-on pattern of the first heater and the turn-on pattern of the second heater, in which the second heater is turned off when the first heater is turned on and the sum of turn-on power of the partial turn-ons is equal to the sum of turn-on power set from the determined turn-on ratios.

10. The heater control device according to claim 9, wherein when the sum of the turn-on ratios of the first heater and the second heater is equal to or less than the first threshold, the turn-on pattern decision unit further determines whether one of the turn-on ratios of the first heater and the second heater is 0%, and determines the partial turn-on patterns, as the turn-on pattern of the first heater and the turn-on pattern of the second heater, when neither of the turn-on ratios is 0%.

11. The heater control device according to claim 10, wherein the turn-on pattern decision unit includes a turn-on pattern storage unit that stores therein the turn-on patterns, associated with the turn-on ratios, which are patterns in terms of the control period and in which full turn-ons or full turn-offs are allocated to half-wavelengths within the control period, a turn-on pattern extraction unit that, when the sum of the turn-on ratios of the first heater and the second heater is equal to or less than the first threshold and neither of the turn-on ratios is 0%, extracts two turn-on patterns which are the turn-on patterns associated with the turn-on ratios higher than the determined turn-on ratios and in which the second heater is turned off when the first heater is turned on, from the turn-on pattern storage unit, and a partial turn-on allocation unit that determines the partial turn-on patterns as the turn-on pattern of the first heater and the turn-on pattern of the second heater, by allocating partial turn-ons, instead of full turn-ons, in which the sum of turn-on power of the partial turn-ons is equal to the sum of turn-on power set from the determined turn-on ratios, to the half-wavelengths allocated with the full turn-ons of the extracted two turn-on patterns.

12. The heater control device according to claim 10, wherein when one of the turn-on ratios of the first heater and the second heater is 0%, the turn-on pattern decision unit determines the partial turn-on pattern as the turn-on pattern of which turn-on ratio is not 0%.

13. The heater control device according to claim 9, wherein when the sum of the turn-on ratios of the first heater and the second heater is higher than the first threshold and is equal to or less than a second threshold, the turn-on pattern decision unit determines the partial turn-on patterns in which the turn-on ratio of the first heater and the turn-on ratio of the second heater total 100%, as the turn-on pattern of the first heater and the turn-on pattern of the second heater.

14. The heater control device according to claim 13, wherein the turn-on pattern decision unit includes a turn-on pattern storage unit that stores therein the turn-on patterns, associated with the turn-on ratios, which are patterns in terms of the control period and in which full turn-ons or full turn-offs are allocated to half-wavelengths within the control period, a turn-on pattern extraction unit that, when the sum of the turn-on ratios of the first heater and the second heater is higher than the first threshold and is equal to or less than the second threshold, extracts two turn-on patterns in which a turn-on ratio of the first heater and a turn-on ratio of the second heater total 100%, which are associated with turn-on ratios higher than the determined turn-on ratios, and in which the second heater is turned off when the first heater is turned on, from the turn-on pattern storage unit, and a partial turn-on allocation unit that determines the partial turn-on patterns as the turn-on pattern of the first heater and the turn-on pattern of the second heater, by allocating partial turn-ons, instead of full turn-ons, in which the sum of turn-on power of the partial turn-ons is equal to the sum of turn-on power set from the determined turn-on ratios, to the half-wavelengths allocated with the full turn-ons of the extracted two turn-on patterns.

15. The heater control device according to claim 13, wherein when the sum of the turn-on ratios of the first heater and the second heater is higher than the first threshold and is higher than the second threshold, the turn-on pattern decision unit determines the turn-on patterns corresponding to the determined turn-on ratios in terms of the control period, as the turn-on patterns of the first heater and the second heater respectively.

16. The heater control device according to claim 15, wherein the turn-on pattern decision unit includes a turn-on pattern storage unit that stores therein the turn-on patterns, associated with the turn-on ratios, which are patterns in terms of the control period and in which full turn-ons or full turn-offs are allocated to half-wavelengths within the control period, and a turn-on pattern extraction unit that, when the sum of the turn-on ratios of the first heater and the second heater is higher than the first threshold and is higher than the second threshold, extracts two turn-on patterns corresponding to the determined turn-on ratios, from the turn-on pattern storage unit, to determine the turn-on patterns corresponding to the determined turn-on ratios in terms of the control period as the turn-on patterns of the first heater and the second heater.

17. The heater control device according to claim 9, wherein when the sum of the turn-on ratios of the first heater and the second heater is equal to or less than the first threshold and an amount of consumed power of the first heater is higher than an amount of consumed power of the second heater, the turn-on pattern decision unit determines the partial turn-on patterns of patterns in which the turn-on ratios total 100% and the turn-on ratio of the first heater is higher than the turn-on ratio of the second heater, as the turn-on pattern of the first heater and the turn-on pattern of the second heater.

18. The heater control device according to claim 17, wherein the turn-on pattern decision unit includes a turn-on pattern storage unit that stores therein the turn-on patterns, associated with the turn-on ratios, which are patterns in terms of the control period and in which full turn-ons or full turn-offs are allocated to half-wavelengths within the control period, a turn-on pattern extraction unit that, when the sum of the turn-on ratios of the first heater and the second heater is equal to or less than a first threshold and an amount of consumed power of the first heater is higher than an amount of consumed power of the second heater, extracts two turn-on patterns, of which the turn-on ratios total 100% and in which the turn-on ratio of the first heater is higher than the turn-on ratio of the second heater and the second heater is turned off when the first heater is turned on, from the turn-on pattern storage unit, and a partial turn-on allocation unit that determines the partial turn-on patterns as the turn-on pattern of the first heater and the turn-on pattern of the second heater, by allocating partial turn-ons, instead of full turn-ons, in which the sum of turn-on power of the partial turn-ons is equal to the sum of turn-on power set from the determined turn-on ratios, to the half-wavelengths allocated with the full turn-ons of the extracted two turn-on patterns based on the turn-on ratio of the first heater or based on the turn-on ratio of the second heater.

19. An image forming apparatus comprising:

a fixing unit that includes a heater, and a temperature detector for detecting a temperature of a heated object heated by the heater;

an alternating-current power supply for applying an alternating current voltage to the heater;

a turn-on ratio decision unit that determines a turn-on ratio of the heater based on the temperature and a target temperature;

a turn-on pattern decision unit that determines a partial turn-on pattern, as a turn-on pattern of the heater, which is a pattern of a turn-on ratio higher than determined turn-on ratio in terms of a control-period, and to which a partial turn-on instead of a full turn-on is allocated on a half-wavelength basis of the alternating current voltage within the control period, based on the turn-on ratio of the heater; and a turn-on controller that controls turn-on of the heater based on determined turn-on pattern.

* * * * *